US005419395A

United States Patent [19]

Harvey et al.

[11] Patent Number: 5,419,395

[45] Date of Patent: May 30, 1995

[54] ECCENTRIC FLUID DISPLACEMENT SLEEVE

[75] Inventors: Peter R. Harvey, Houston, Tex.; George S. Findlay, Aberdeen, Scotland; Denis P. Biglin, Leonie Gardens, Singapore; James Babek, Middletown, Conn.

[73] Assignee: Baker Hughes Incorporated, Houston, Tex.

[21] Appl. No.: 152,446

[22] Filed: Nov. 12, 1993

[51] Int. Cl.[6] ..... E21B 17/10

[52] U.S. Cl. ..... 166/241.6; 175/325.1; 250/268

[58] Field of Search ..... 175/50, 325.1; 166/241.1, -241.7; 250/254, 264, 268, 269

[56] References Cited

U.S. PATENT DOCUMENTS

| | | | |
|---|---|---|---|
| 2,470,743 | 5/1949 | Hochgesang et al. . | |
| 2,843,752 | 7/1958 | Goodman | 250/268 |
| 2,940,039 | 6/1960 | Yost et al. . | |
| 3,255,353 | 6/1966 | Scherbatskoy . | |
| 3,714,831 | 2/1973 | Quichaud et al. . | |
| 3,864,569 | 2/1975 | Tittman | 250/264 |
| 3,933,203 | 1/1976 | Evans | 166/241.6 |
| 4,387,372 | 6/1983 | Smith et al. . | |
| 4,593,770 | 6/1986 | Hoehn, Jr. . | |
| 4,661,700 | 4/1987 | Holenka | 250/267 |
| 4,814,609 | 3/1989 | Wraight et al. | 250/254 |
| 4,904,865 | 2/1990 | Meisner et al. . | |
| 4,984,633 | 1/1991 | Langer et al. | 166/241.1 |
| 5,019,708 | 5/1991 | Flaum | 250/264 |
| 5,091,644 | 2/1992 | Minette . | |
| 5,095,981 | 3/1992 | Mikolajczyk | 166/241.6 |
| 5,120,963 | 6/1992 | Robinson et al. . | |
| 5,126,564 | 6/1992 | Perry et al. . | |
| 5,134,285 | 7/1992 | Perry et al. . | |
| 5,184,692 | 2/1993 | Moriarty . | |
| 5,250,806 | 10/1993 | Rhein-Knudsen et al. | 250/269 X |

*Primary Examiner*—Ramon S. Britts
*Assistant Examiner*—Frank S. Tsay
*Attorney, Agent, or Firm*—Nydegger & Associates

[57] ABSTRACT

An eccentric fluid displacement sleeve is disclosed for use with a measurement-while-drilling instrument, to convert the instrument for use in different size boreholes. The sleeve is made eccentric by either increasing or decreasing the thicknesses of positioning blades on the periphery of the sleeve, while maintaining the thickness of the fluid displacement blade aligned with the detectors.

15 Claims, 3 Drawing Sheets

ECCENTRIC FLUID DISPLACEMENT SLEEVE

TECHNICAL FIELD

This invention relates generally to borehole logging apparatus for performing nuclear radiation based measurements. More particularly, this invention relates to a new and improved apparatus for effecting formation density logging using gamma rays wherein the improved nuclear logging apparatus includes a sleeve designed to adapt the nuclear instrument for use in different sizes of boreholes.

BACKGROUND OF THE INVENTION

Oil well logging has been known for many years and provides an oil and gas well driller with information about the particular earth formation being drilled. In one type of oil well logging, after a well has been drilled, a probe, or sonde is lowered into the borehole to measure certain characteristics of the formations through which the well has passed. The probe hangs on the end of a cable which gives mechanical support to the sonde and which provides power to the sonde. The cable also conducts information up to the surface. Such "wireline" measurements are made after the drilling has taken place.

A wireline sonde usually contains a source which transmits energy into the formation as well as a suitable receiver for detecting energy returning from the formation. The energy can be nuclear, electrical, or acoustic. Wireline "gamma-gamma" probes, for measuring formation density, are well known devices incorporating a gamma ray source and a gamma ray detector. During operation of the probe, gamma rays emitted from the source enter the formation to be studied, and interact with the atomic electrons of the material of the formation by the photoelectric absorption, by Compton scattering, or by pair production. In photoelectric absorption and pair production phenomena, the particular gamma rays involved in the interaction are consumed in the process.

In the Compton scattering process, the involved gamma ray loses some of its energy and changes its original direction of travel, the amount of energy loss being related to the amount of change in direction. Some of the gamma rays emitted from the source into the formation are scattered by this process toward the detector. Many of these rays fail to reach the detector, since their direction is again changed by a second Compton scattering, or they are absorbed by the photoelectric absorption process or the pair production process. The scattered gamma rays that ultimately reach the detector and interact with it are counted by the electronic circuitry associated with the detector.

Wireline formation evaluation tools such as the aforementioned gamma ray density tools have many drawbacks and disadvantages, including loss of drilling time and the expense involved in pulling the drillstring so as to enable the wireline to be lowered into the borehole. In addition, a substantial mud cake can build up, and the formation can be invaded by drilling fluids during the time period that drilling is suspended. An improvement over these wireline techniques is the technique of measurement-while-drilling (MWD), which measures many of the characteristics of the formation during the drilling of the borehole. Measurement-while-drilling can totally eliminate the necessity for interrupting the drilling operation to remove the drillstring from the borehole. The present invention relates to a measurement-while-drilling apparatus. Specifically, this invention is most useful in such an instrument which measures the density of the formation wherein the source emits gamma rays.

In a typical MWD density tool, an instrument housing, such as a drill collar, is provided which incorporates a single gamma ray source and a pair of longitudinally displaced and mutually aligned detector assemblies. A nuclear source is mounted in a pocket in the drill collar wall and partially surrounded by gamma ray shielding. The two detector assemblies are mounted within a cavity or hatch formed in the drill collar wall and enclosed by a detector hatch cover under ambient pressure. The detector assemblies are spaced from the source and partially surrounded by gamma ray shielding to provide accurate response from the formation. The hatch cover contains radiation transparent windows in alignment with the detector assemblies.

The density instrument housing may include a central bore for internal flow of drilling fluid. The drill collar wall section adjacent to the source can be expanded radially so as to define a lobe which essentially occupies the annulus between the drill collar and the borehole wall. A radiation transparent window is provided in the lobe to allow gamma rays to reach the formation, and the surrounding lobe material reduces the propagation of gamma rays into the annulus. Reduction of the gamma ray flux down the annulus is desirable to reduce the number of gamma rays which reach the detector through the drilling fluid without passing through the formation.

Another means frequently used to reduce the gamma ray flux through the drilling fluid to the detectors is a threaded-on fluid displacement sleeve positioned on the drill collar and over the detector hatch cover. Examples of such a sleeve can be found in U.S. Pat. Nos. 5,091,644 and 5,134,285. In lieu of the lobe around the source port described above, the fluid displacement sleeve can extend over the source port as well as the detector ports. This sleeve displaces borehole fluids as mentioned above, reduces mudcaking which might have an adverse effect on the measurement, and maintains a relatively constant distance between the formation and the detector. The sleeve typically used has blades which are full gage diameter, matching the borehole diameter, or they can be slightly under gage, and adequate flow area for drilling fluids is provided between the blades. One blade is positioned between the detectors and the borehole wall to displace fluid from the annular space between the detectors and the formation. The other blades are positioning blades which position the instrument centrally within the borehole and which hold the fluid displacement blade against the formation. The blades are hard faced with wear resistant material. The threading and shoulders of the sleeves are configured so as to adequately secure the sleeve to the drill collar without rotation while drilling. The sleeve may be replaced at the drilling site when worn or damaged.

The problem with MWD instruments of this type is that a different instrument is required for each diameter of borehole. Detector to formation distance is critical, and drilling fluid must be displaced from the annular space between the detector and the borehole wall. Therefore, each borehole diameter requires the design and manufacture of an instrument, instrument housing, and fluid displacement sleeve specifically intended for use only in a borehole of the given diameter. Not only is design and manufacture of a full range of tools expensive, but each tool must be extensively modeled and mathematically calibrated for use in the given diameter of borehole, and acceptance testing must be performed on each different design. Even if a single instrument were used, with different diameters of fluid displacement sleeves, calibration and modeling effort would be necessary for each sleeve design. Further, the use of a different tool in each diameter of borehole requires a logging company to maintain a large inventory of tools, along with the associated difficulty in handling, storing, and testing such tools.

There is a continuing need, therefore, for an improved MWD density tool in which a single design instrument can be used in a variety of different sizes of boreholes without the need for recalibration, computer modeling, or repeated acceptance testing. Specifically, improvements are possible in achieving accurate and reliable measurements, with a single instrument, in different size boreholes, while minimizing the presence of drilling fluid between the tool's nuclear detectors and the formation.

SUMMARY OF THE INVENTION

The present invention comprises a fluid displacement sleeve designed to convert a single design of nuclear instrument for use in a variety of different diameter boreholes. The conversion from one size of borehole is accomplished by using a fluid displacement sleeve specifically designed for the desired size of borehole.

Given a nuclear instrument designed for use in a nominal size of borehole, the original fluid displacement sleeve will have blades of a given thickness, designed to center the instrument within the borehole. Typically, three blades are used, but other numbers of blades are possible. One of the blades will have the radiation transparent windows, and this blade will be the fluid displacement blade intended for placement between the detector and the borehole wall. The positioning blades on the sleeve for which the instrument is originally designed will have thicknesses matching the thickness of the fluid displacement blade, thereby centering the instrument within the borehole. Therefore, the original sleeve is a concentric fluid displacement sleeve.

When it is desired to use the instrument in a larger or smaller borehole, the original sleeve is removed from the drill collar and replaced with a sleeve of the present invention. If the new borehole diameter is larger than the nominal diameter for which the instrument is designed, the new sleeve will have a fluid displacement blade with the same thickness as the original blade, but the positioning blades will be thicker. This creates an eccentric sleeve which displaces the instrument housing centerline from the borehole centerline, keeping the fluid displacement blade in contact with the borehole wall. Significantly less computer modeling, acceptance testing, or recalibration is required, since the detector maintains the same distance from the borehole wall as in the original design.

On the other hand, if the new borehole diameter is smaller than the nominal diameter for which the instrument is designed, the new sleeve will still have a fluid displacement blade with the same thickness as the original blade, but the positioning blades will be thinner. This creates an eccentric sleeve which displaces the instrument housing centerline from the borehole centerline, allowing the instrument to fit in a smaller hole than the nominal diameter, and keeping the fluid displacement blade in contact with the borehole wall. Here again, no new computer modeling, acceptance testing, or recalibration is required, since the detector maintains the same distance from the borehole wall as in the original design.

The novel features of this invention, as well as the invention itself, both as to its structure and its operation, will be best understood from the accompanying drawings, taken in conjunction with the accompanying description, in which similar reference characters refer to similar parts, and in which:

DESCRIPTION OF PREFERRED EMBODIMENTS

Figure 1:
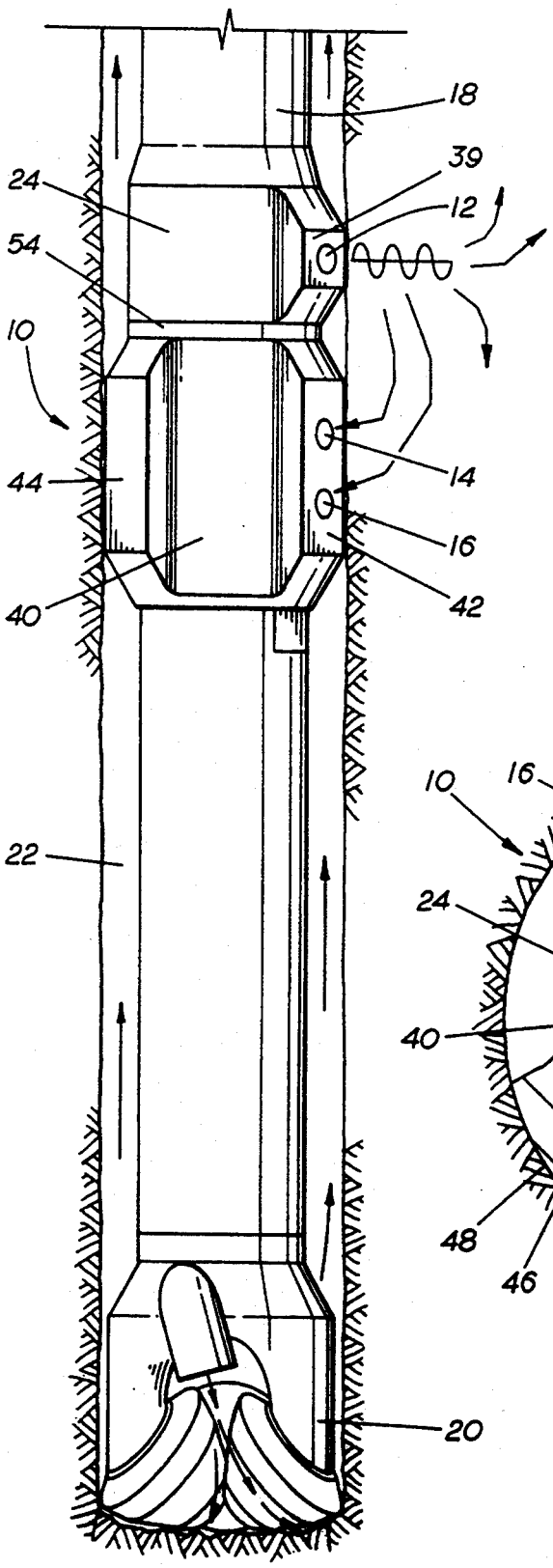
FIG. 1 (PRIOR ART)
FIG. 1 is a perspective view of an MWD instrument, as known in the prior art, in use in a drillstring in a borehole.
Figure 2:
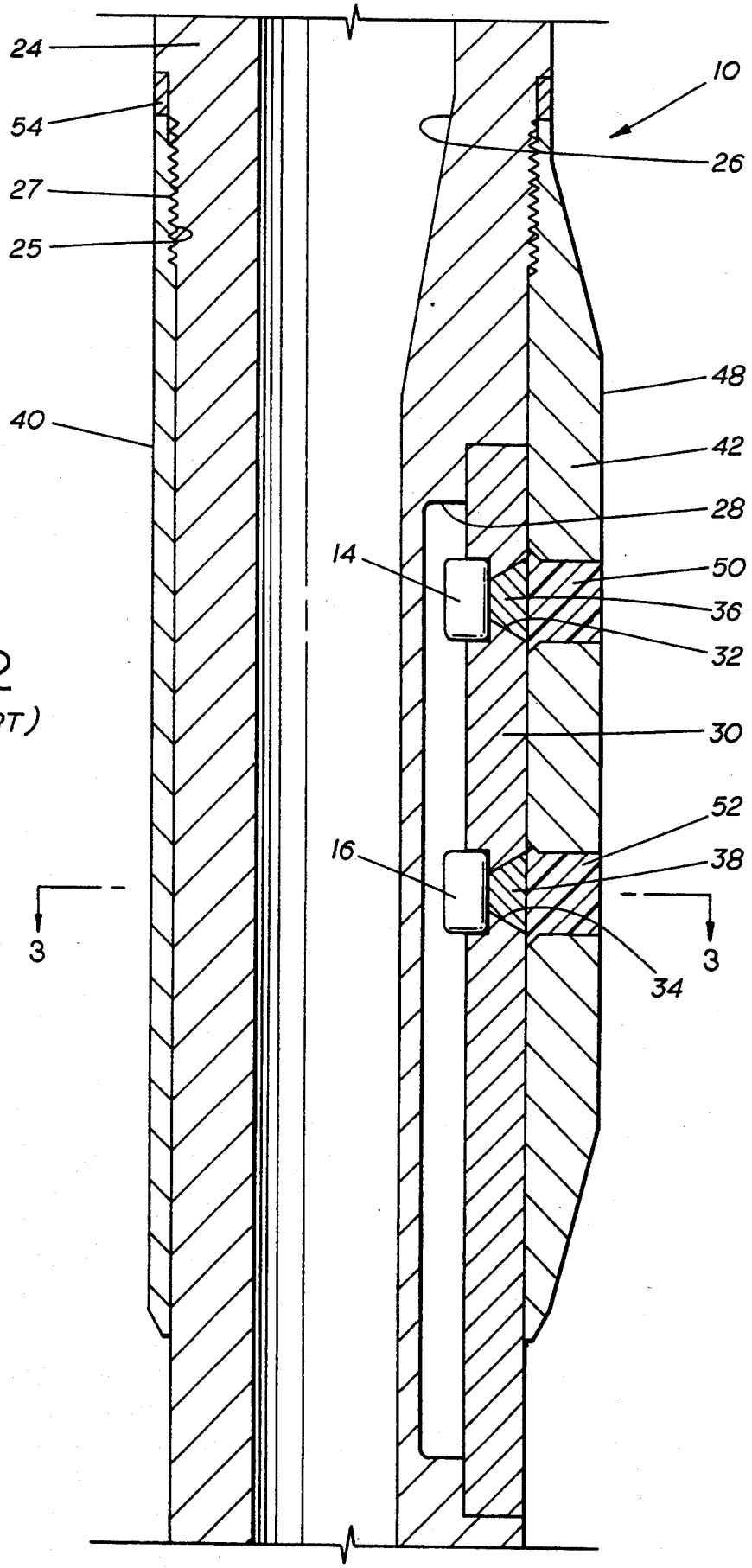
FIG. 2 (PRIOR ART)
FIG. 2 is a longitudinal section view of the MWD instrument shown in FIG. 1, showing the typical layout of the detectors and the fluid displacement blade.

Referring first to FIG. 1, a diagram of the basic components for a gamma-ray density tool 10 as known in the prior art is shown. This tool comprises a drill collar 24 which contains a gamma-ray source 12 and two spaced gamma-ray detector assemblies 14 and 16. All three components are placed along a single axis that has been located parallel to the axis of the tool. As seen in FIG. 2, detectors 14, 16 can be mounted in cavity 28, along with associated circuitry (not shown), by known means. The detector 14 closest to the gamma-ray source will be referred to as the "short space detector" and the detector 16 farthest away is referred to as the "long space detector". Gamma-ray shielding is located between detector assemblies 14, 16 and source 12. Windows open up to the formation from both the detector assemblies and the source.

Drilling fluid, indicated by arrows, flows down through a bore in drillstring 18 and out through bit 20. A layer of drilling fluid returning to the surface is present between the formation and the detector assemblies and source. Drill cuttings produced by the operation of drill bit 20 are carried away by the drilling fluid rising up through the free annular space 22 between the drillstring and the wall of the borehole. An area of drill collar 24 overlying source 12 is raised to define a fluid displacing lobe 39. Lobe 39 displaces drilling mud between drill collar 24 and the borehole wall thereby improving the density measurement.

The tool 10 is placed into service by loading it with a sealed gamma source and lowering it into a formation. Gamma-rays are continuously emitted by the source and these propagate out into the formation. Two physical processes dominate the scattering and absorption of gamma rays at the energies used in density tools. They are Compton scattering and photoelectric absorption. The probability of Compton scattering is proportional to the electron density in the formation and is weakly dependent on the energy of the incident gamma ray. Since the electron density is, for most formations, approximately proportional to the bulk density, the amount of Compton scattering is proportional to the density of the formation.

Formation density is determined by measuring the return of gamma rays through the formation. Shielding within the tool minimizes the flux of gamma rays straight through the tool. This flux can be viewed as background noise for the formation signal. As seen in FIG. 2, the windows 36, 38, 50, 52 in the detector hatch cover 30 and fluid displacement blade 42 increase the number of gamma rays returning from the formation to the detectors. The thickness of the layer of mud between the tool and the formation is minimized by the use of fluid displacement sleeve 40.

Fluid displacement sleeve 40 displaces borehole fluids, reduces mud cake which might have an adverse effect on the measurement, and maintains a relatively constant formation to detector distance. Fluid displacement sleeve 40 is threadably attached over drill collar 24 at threads 25,27. Sleeve 40 surrounds the nuclear instrument and particularly the two windows 36 and 38 in hatch cover 30. An internal bore 26 carries drilling fluid down through instrument 10.

Figure 3:
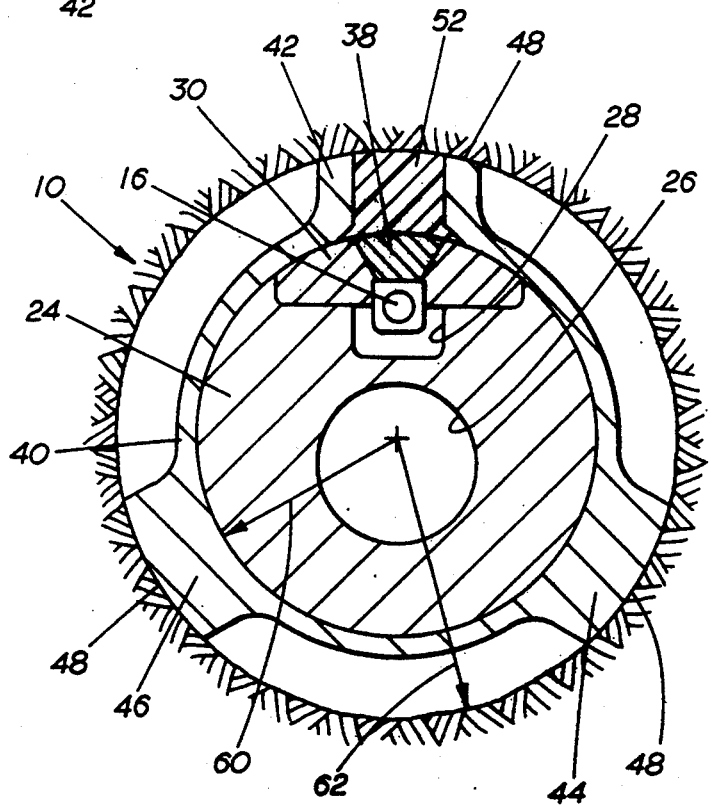
FIG. 3 (PRIOR ART)
FIG. 3 is a transverse section view of the MWD instrument shown in FIG. 1, showing the equal blade lengths found in the prior art concentric sleeve.

As seen in FIG. 3, the outer surface of sleeve 40 is provided with three blades 42, 44, and 46. Each blade 42, 44, and 46 may be formed by any number of known methods. Preferably, each blade is formed by machining out the area between the blades as shown in FIG. 3. In a manner similar to lobe 39, each blade of sleeve 40 is fully gaged to the radius 62 of the borehole, or nearly full gage, and provided with a hardened surface 48 on the outer edges thereof made from an appropriate material such as tungsten carbide. The valley areas between blades 42, 44, and 46 are optimized so as to give adequate flow area for drilling fluid flowing through the annulus between the borehole wall and the density tool. Openings 50, 52 through blade 42 and are spaced from each other so as to be positioned over windows 36 and 38. Each opening 50, 52 is filled with a low atomic number (low Z), low density, high wear filler material such as rubber or epoxy. Windows 36, 38 are formed of a radiation transparent, high strength, low Z material such as beryllium.

Thread 27 on the outer surface of drill collar 24 mates with thread 25 internally provided on sleeve 40 for effecting the attachment of sleeve 40 to drill collar 24. The internal radius of sleeve 40 is slightly larger than the outer radius 60 of drill collar 24. Angular alignment with the detector assemblies is achieved by selecting the proper spacer 54 that will yield an acceptable makeup torque when in position. Torquing can be done with tongs or with a free standing torque machine.

Figure 4:
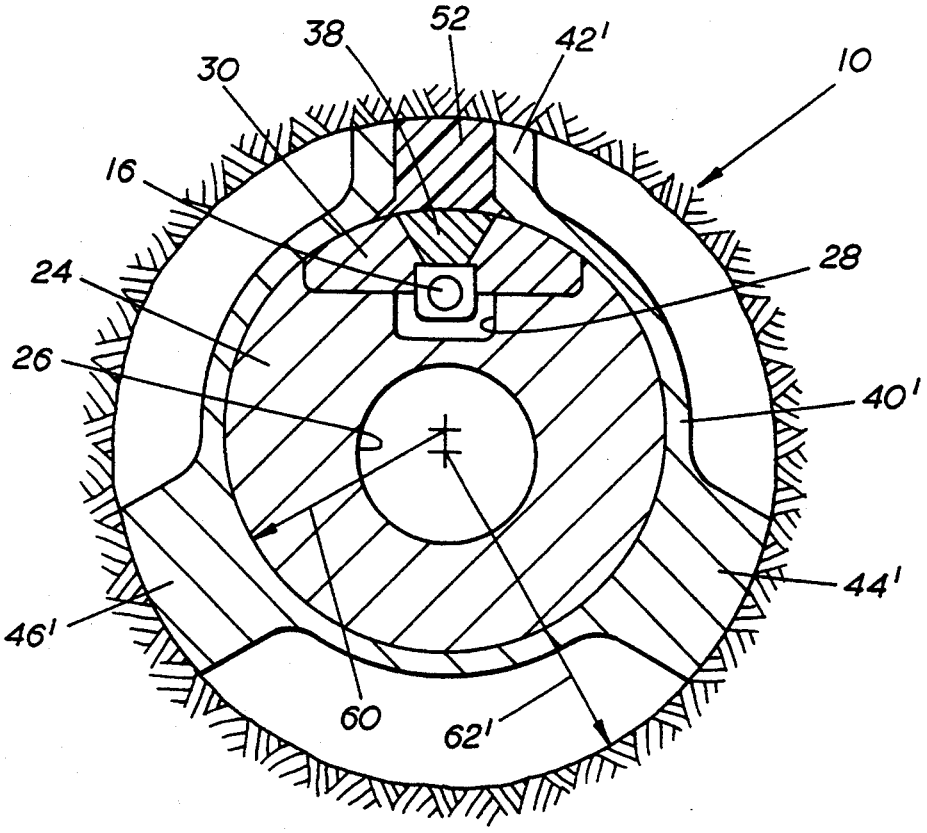
FIG. 4 is a transverse section view of the MWD instrument with an eccentric sleeve of the present invention, showing the increased thickness of the positioning blades, intended for use in a borehole with a larger than nominal diameter.
Figure 5:
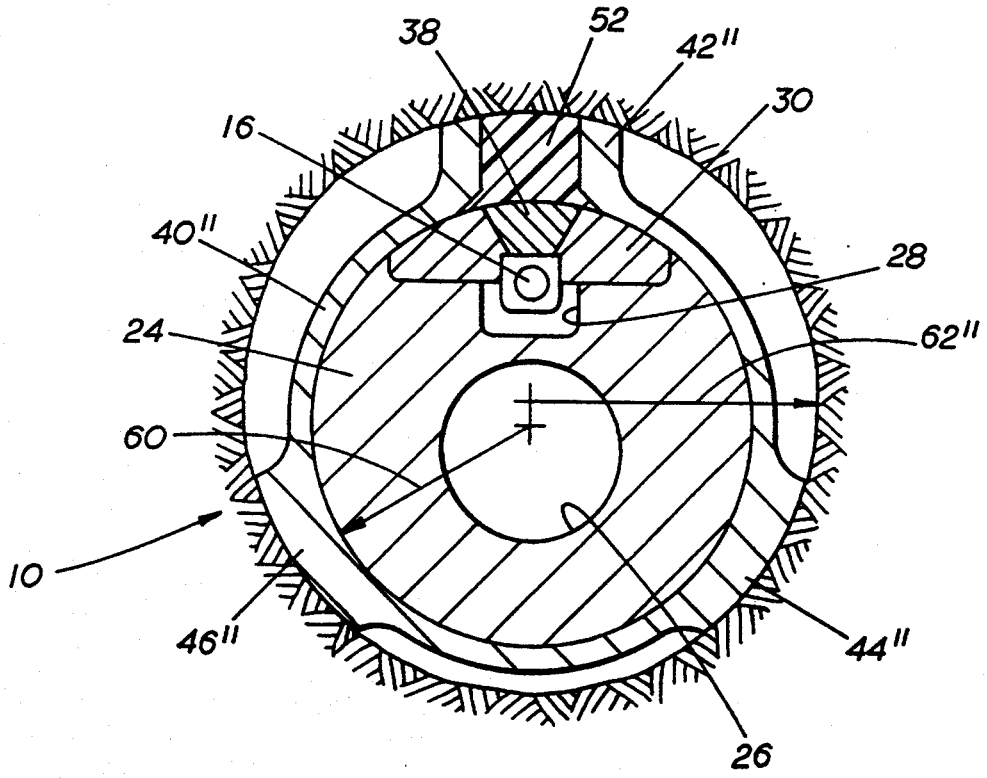
FIG. 5 is a transverse section view of the MWD instrument with an eccentric sleeve of the present invention, showing the decreased thickness of the positioning blades, intended for use in a borehole with a smaller than nominal diameter.

Fluid displacement sleeve 40 may be easily replaceable when worn or damaged, or when it is desired to convert the instrument 10 for use in a different size borehole. As seen in FIG. 4, when it is desired to use instrument 10 in a larger than nominal diameter borehole, sleeve 40 can be unthreaded from drill collar 24 and replaced with sleeve 40'. On sleeve 40', fluid displacement blade 42' has the same thickness as fluid displacement blade 42 on sleeve 40. However, positioning blades 44', 46' are thicker than positioning blades 44, 46 on sleeve 40. This increases the outer radius 62' of sleeve 40' to match the radius of the larger borehole.

Similarly, when it is desired to use instrument 10 in a smaller than nominal diameter borehole, sleeve 40 can be unthreaded from drill collar 24 and replaced with sleeve 40''. On sleeve 40'', fluid displacement blade 42'' has the same thickness as fluid displacement blade 42 on sleeve 40. However, positioning blades 44'', 46'' are thinner than positioning blades 44, 46 on sleeve 40. This decreases the outer radius 62'' of sleeve 40'' to match the radius of the smaller borehole.

While the particular eccentric fluid displacement sleeve as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

I claim:

1. A sleeve for positioning a formation evaluation instrument radially offset from the centerline of a borehole to allow use of the instrument in a second borehole having a second diameter different from a nominal first diameter of a first borehole for which the instrument is calibrated, said sleeve comprising:

a generally cylindrical body for receiving the formation evaluation instrument;

a fluid displacement blade attached to said body, said fluid displacement blade having a radially outermost surface for contacting the wall of the second borehole for displacing fluid from a space between a detector within the instrument and the wall of the borehole; and at least one positioning blade attached to said body, said positioning blade having a radially outermost surface for contacting the borehole wall to position said outermost surface of said fluid displacement blade against the borehole wall;

wherein said fluid displacement blade has a first radial thickness to which the detector is calibrated; and wherein said at least one positioning blade has a second radial thickness different from said first radial thickness, said second radial thickness being sized to position said outermost surface of said fluid displacement blade against the borehole wall, thereby positioning the cylindrical body eccentrically with respect to the centerline of the second borehole.

2. A sleeve as claimed in claim 1, wherein said sleeve is constructed to be removed from the formation evaluation instrument and replaced with a second sleeve having a fluid displacement blade with a first radial thickness the same as said first radial thickness of said fluid displacement blade on said first sleeve, and having at least one positioning blade with a second radial thickness different from said second radial thickness of said positioning blade on said first sleeve, thereby adapting the formation evaluation instrument for use in a third borehole having a third diameter different from the second diameter of the second borehole.

3. A sleeve as claimed in claim 2, wherein said fluid displacement blade projects radially from said body.

4. A sleeve as claimed in claim 3, wherein said fluid displacement blade projects outwardly from said body.

5. A sleeve as claimed in claim 4, wherein said positioning blade projects radially outwardly from said body.

6. A sleeve as claimed in claim 5, further comprising a plurality of positioning blades projecting radially outwardly from said body at spaced intervals, said positioning blades having radial thicknesses sized so that said outermost surfaces of said positioning blades contact the borehole wall and position said outermost surface of said fluid displacement blade against the borehole wall.

7. A sleeve as claimed in claim 5, wherein said second radial thickness of said positioning blade is greater than said first radial thickness of said fluid displacement blade, adapting the instrument for use in a second borehole having a second diameter greater than the nominal first diameter of the first borehole.

8. A sleeve as claimed in claim 5, wherein said second radial thickness of said positioning blade is less than said first radial thickness of said fluid displacement blade, adapting the instrument for use in a second borehole having a second diameter less than the nominal first diameter of the first borehole.

9. A formation evaluation tool for evaluating an earth formation by transmitting radiation into the formation and receiving radiation returned by the formation, said tool comprising:

an instrument housing designed for use in a first borehole having a first nominal diameter;

a window in said housing;

a radiation detector positioned within said housing and oriented to receive radiation returned by the formation through said window;

a sleeve removably mounted around said housing, for positioning said housing radially offset from the centerline of a second borehole, enabling use of said housing in a second borehole having a second diameter different from the first nominal diameter;

a fluid displacement blade on said sleeve, aligned radially outwardly from said detector, for displacing fluid from a space between said detector and the wall of the second borehole, said fluid displacement blade having a first radial thickness for which said detector is calibrated; and a positioning blade on said sleeve, for contacting the borehole wall to position said fluid displacement blade against the wall of the second borehole;

wherein said positioning blade has a second radial thickness different from said first radial thickness, said second radial thickness being sized to position said fluid displacement blade against the borehole wall in the second borehole.

10. A formation evaluation tool as claimed in claim 9, wherein said fluid displacement blade projects radially outwardly from said sleeve, and further comprising a plurality of positioning blades projecting radially outwardly from said sleeve.

11. A formation evaluation tool as claimed in claim 10, wherein said second radial thickness of each of said positioning blades is greater than said first radial thickness of said fluid displacement blade, adapting said instrument housing for use in a second borehole having a second diameter greater than said first nominal diameter.

12. A formation evaluation tool as claimed in claim 10, wherein said second radial thickness of each of said positioning blades is less than said first radial thickness of said fluid displacement blade, adapting said instrument housing for use in a second borehole having a second diameter smaller than said first nominal diameter.

13. A formation evaluation tool as claimed in claim 9, further comprising a plurality of interchangeable sleeves, each of which can be selectively mounted around said housing to adapt said housing for use in a different borehole having a different diameter from said first nominal diameter.

14. A formation evaluation tool for evaluating an earth formation by transmitting radiation into the formation and receiving radiation returned by the formation, said tool comprising:

an instrument housing designed for use in a first borehole having a first nominal diameter;

a window in said housing;

a radiation detector positioned within said housing and oriented to receive radiation returned by the formation through said window;

a sleeve removably mounted around said housing;

a fluid displacement blade projecting radially outwardly from said sleeve, and aligned radially outwardly from said detector, for displacing fluid from a space between said detector and the wall of the borehole; and a plurality of positioning blades projecting radially outwardly from said sleeve, for contacting the borehole wall to position an outer surface of said fluid displacement blade against the wall of the borehole;

wherein said fluid displacement blade has a first radial thickness and said detector is calibrated for use with said fluid displacement blade having said first radial thickness; and wherein each of said positioning blades has a greater radial thickness than said fluid displacement blade, thereby offsetting said instrument housing radially from the centerline of the borehole and adapting said housing for use in a second borehole having a second diameter greater than said first nominal diameter.

15. A formation evaluation system for evaluating an earth formation by transmitting radiation into the formation from a plurality of different boreholes having a plurality of different diameters and receiving radiation returned by the formation, said system comprising:

an instrument housing designed for use in a first borehole having a first nominal diameter;

a window in said housing;

a radiation detector positioned within said housing and oriented to receive radiation returned by the formation through said window;

a plurality of sleeves, each of which is removably mountable around said housing;

a fluid displacement blade projecting radially outwardly from each said sleeve, and aligned radially outwardly from said detector, for displacing fluid from a space between said detector and the wall of the borehole; and a plurality of positioning blades projecting radially outwardly from each said sleeve, for contacting the borehole wall to position an outer surface of each said fluid displacement blade against the wall of the borehole;

wherein all of said fluid displacement blades have a first radial thickness and said detector is calibrated for use with all of said fluid displacement blades having said first radial thickness;

wherein each of said sleeves has positioning blades having a different radial thickness from said first radial thickness; and wherein each of said sleeves has positioning blades having a different radial thickness from said positioning blades on said other sleeves, each said sleeve thereby having a different overall diameter from said other sleeves, and each said sleeve thereby adapting said housing for use in a different sized borehole from said other sleeves.

* * * * *